US010253633B2

(12) United States Patent
Klaus et al.

(10) Patent No.: US 10,253,633 B2
(45) Date of Patent: Apr. 9, 2019

(54) ROTOR OF AN EXHAUST GAS TURBOCHARGER

(71) Applicant: CONTINENTAL AUTOMOTIVE GMBH, Hannover (DE)

(72) Inventors: Michael Klaus, Tegernheim (DE); Timo Merenda, Regensburg (DE); Bernhard Lehmayr, Regensburg (DE); Meinhard Paffrath, Feldkirchen (DE); Ivo Sandor, Regensburg (DE); Endre Barti, Munich (DE); Utz Wever, Munich (DE)

(73) Assignee: Continental Automotive GmbH, Hannover (DE)

( * ) Notice: Subject to any disclaimer, the term of this patent is extended or adjusted under 35 U.S.C. 154(b) by 352 days.

(21) Appl. No.: 14/416,413

(22) PCT Filed: Jul. 2, 2013

(86) PCT No.: PCT/EP2013/063958
§ 371 (c)(1),
(2) Date: Jan. 22, 2015

(87) PCT Pub. No.: WO2014/016084
PCT Pub. Date: Jan. 30, 2014

(65) Prior Publication Data

US 2015/0204195 A1 Jul. 23, 2015

(30) Foreign Application Priority Data

Jul. 24, 2012 (DE) ..... 10 2012 212 896

(51) Int. Cl.
*F01D 5/22* (2006.01)
*F01D 5/14* (2006.01)
(Continued)

(52) U.S. Cl.
CPC ..... *F01D 5/141* (2013.01); *F01D 5/14* (2013.01); *F04D 25/024* (2013.01);
(Continued)

(58) Field of Classification Search
CPC ..... F01D 5/141; F01D 5/14; F04D 25/024; F04D 29/284; F05D 2220/40;
(Continued)

(56) References Cited

U.S. PATENT DOCUMENTS 2,469,458 A 5/1949 Dunnells et al.
4,587,700 A * 5/1986 Curbishley ..... B23P 15/006 219/121.72
(Continued)

FOREIGN PATENT DOCUMENTS

CN 1771397 A 5/2006
CN 1791737 A 6/2006
(Continued)

*Primary Examiner* — Justin Seabe
*Assistant Examiner* — Jason Mikus
(74) *Attorney, Agent, or Firm* — Laurence A. Greenberg; Werner H. Stemer; Ralph E. Locher

(57) ABSTRACT

A rotor of an exhaust-gas turbocharger includes a rotor hub and rotor blades disposed on the rotor hub. The rotor blades have a blade thickness distribution selected in such a way that the rotor blades have along their extent from a fluid inlet or leading edge to a fluid outlet or trailing edge at least one transition between a stiffness or rigidity-oriented blade thickness distribution and an inertia and stress-oriented blade thickness distribution over the height of the blade.

9 Claims, 4 Drawing Sheets

(51) Int. Cl.
*F04D 29/28* (2006.01)
*F04D 25/02* (2006.01)
*F04D 29/30* (2006.01)

(52) U.S. Cl.
CPC ..... *F04D 29/284* (2013.01); *F04D 29/30* (2013.01); *F05D 2220/40* (2013.01); *F05D 2240/301* (2013.01); *F05D 2250/711* (2013.01); *F05D 2250/712* (2013.01)

(58) Field of Classification Search
CPC ..... F05D 2240/301; F05D 2250/711; F05D 2250/712
USPC ..... 416/185
See application file for complete search history.

(56) References Cited

U.S. PATENT DOCUMENTS 5,408,747 A * 4/1995 Fredmonski ..... F01D 5/048 29/889
7,395,668 B2 7/2008 Gobert et al.
7,517,193 B2 * 4/2009 Higashimori ..... F04D 21/00 416/185
8,696,316 B2 4/2014 Decker et al.
2005/0260074 A1 11/2005 Higashimori
2010/0278633 A1 * 11/2010 Duong ..... F04D 29/284 415/119
2011/0020152 A1 1/2011 Ising

FOREIGN PATENT DOCUMENTS

CN 101983281 A 3/2011
DE 19612396 C2 2/1998
DE 102008059874 A1 6/2010
DE 112008002864 T5 7/2011
GB 941344 A 11/1963
GB 1053509 A 1/1967
WO 2009065030 A2 5/2009

* cited by examiner

ROTOR OF AN EXHAUST GAS TURBOCHARGER

BACKGROUND OF THE INVENTION

Field of the Invention

The invention relates to a rotor of an exhaust-gas turbocharger, which rotor has a rotor hub and rotor blades arranged on the rotor hub, which rotor blades each comprise a fluid inlet edge and a fluid outlet edge and each have a blade thickness distribution running in the flow direction of the fluid mass flow.

Owing to ever more stringent laws regarding the emissions of exhaust gases into the environment, increasing numbers of vehicles are being equipped with diesel or gasoline engines with exhaust gas turbocharging. Furthermore, the demands on the steady-state behavior of the internal combustion engine are increasing, that is to say power, torque and consumption must be further improved. In the case of internal combustion engines with turbocharging, the transient response behavior in particular is also essential. A rotor blade arrangement which is as lightweight as possible makes it possible to realize turbomachines with a low moment of inertia, whereby improved transient response behavior can be achieved. The minimum possible blade thickness is limited by the production method and by the strength characteristics of the materials that are used. Aside from centrifugal forces, the rotor blades are acted on by aerodynamic forces in the form of shear stresses and pressure forces. When turbomachines are impinged on by flow, pressure non-uniformities arise which act on the rotor blades during every rotation. The rotor blades must have a rigidity which increases their natural frequency to such an extent that they cannot be incited to perform critical vibrations by said pressure pulsations.

It is already known to provide a thickness distribution of the rotor blades of an exhaust-gas turbocharger in a radial direction with a linearly decreasing thickness profile from small diameter to large diameter. Instead of the radial rays, it is also possible for rays that are perpendicular to the flow duct, so-called meridional rays, to be used as a basis for definition. Other known solutions are thickness distributions with simple parametric functions, such as for example parabolas or exponential functions. The parameters of the respective function, or the function type itself, are optimized in accordance with strength criteria, such that low mechanical stresses are generated in the rotor blade and in particular in the root region of the rotor blade, also referred to as the blade root, and such that adequate strength of the rotor blade is achieved. In the root region of the blade, the thickness distribution itself is typically covered by a fill radius in the transition to the hub. The larger said radius is, the lower are the stresses, and thus the higher is the strength of the blade. However, the maximum magnitude of the fill radius is limited by manufacturing and aerodynamic criteria. Typically, the rotor blade is thinner at its tip, that is to say in the radial edge region, than at the hub. If the strength or the natural frequency of the blade is not sufficient, it is common for the blade height at the position of the greatest blade height to be of shortened form in the flow direction, which is however aerodynamically disadvantageous. Another possibility consists in making the blade as a whole thicker. These solutions are not optimal either with regard to inertia or with regard to strength. Owing to the relatively poor material utilization, installation space is also taken up that could otherwise be used for additional blades with the same blade root spacing.

DE 10 2008 059 874 A1 discloses a blade of a rotor of a turbocharger, which blade, in the meridional view, at its outlet edge in the case of a turbine rotor blade or at its inlet edge in the case of a compressor rotor blade, has in at least in one or more sections a non-linear reduction of the axial length, and in the case of which blade the respective section and the reduction of the axial length of the blade are selected such that the blade has a predetermined relationship between natural frequency and efficiency loss of the blade or of the rotor. Furthermore, said document discloses a rotor blade which, in the meridional view, at its outlet edge in the case of a turbine rotor blade or at its inlet edge in the case of a compressor rotor blade, is of reduced axial length in a first, upper region, and wherein the outlet edge, in a second, lower region, runs perpendicular, substantially perpendicular or rearward, counter to the flow direction, and/or the inlet edge, in a second, lower region, runs perpendicular, substantially perpendicular or rearward, in the flow direction, such that the efficiency loss of the rotor is limited in a predetermined range.

BRIEF SUMMARY OF THE INVENTION

It is the object of the invention to specify a rotor of an exhaust-gas turbocharger which has improved operating characteristics.

Said object is achieved by means of a rotor having the features specified below.

A rotor according to the invention of an exhaust-gas turbocharger has a rotor hub and rotor blades on the rotor hub, which rotor blades each have a fluid inlet edge, a fluid outlet edge and a blade height and a blade thickness distribution. The rotor according to the invention is characterized in that the blade thickness distribution is selected such that the rotor blades have, along their extent from the fluid inlet edge to the fluid outlet edge, that is to say in the flow direction of the fluid flow, at least one transition between a rigidity-oriented blade thickness distribution and an inertia- and stress-oriented blade thickness distribution over the blade height.

In this case, the blade height is to be understood to mean the extent of the respective rotor blade from the transition region between the rotor hub (2) and the rotor blade (3), the blade root or root region (B1), in the radial direction with respect to the rotor axis of rotation to the radial blade edge remote from the rotor hub (2). The extent of the rotor blade in the flow direction of the fluid flow characterizes the "blade length", starting at the fluid inlet edge and ending at the fluid outlet edge of the rotor blade.

An advantageous refinement of the rotor is characterized in that the rigidity-oriented blade thickness distribution is a bottle-shaped blade thickness distribution over the blade height, and the inertia- and stress-oriented blade thickness distribution is an Eiffel Tower-shaped blade thickness distribution over the blade height.

A bottle-shaped blade thickness distribution constitutes a rigidity-optimized geometry and, at least on one side surface of the rotor blade, but preferably on both sides, pressure side and suction side, has a bottle-shaped side surface contour as viewed in a section plane perpendicular to the rotor axis of rotation. Said side surface contour is characterized inter alia by a curvature change region in which, in the direction from radial inside to radial outside, a convex profile of the side surface contour, that is to say of the side surface curvature, in relation to an imaginary central line of the rotor blade cross section under consideration changes into a concave profile.

In a refinement of the subject matter, said side surface contour has in each case one straight or one curve first transition region between the blade root and the curvature change region. Thus, a basic form with a bulged, rigid root is formed, wherein the blade thickness initially decreases slowly (bottle bulge) in the radially outward direction as far as into the curvature change region. In the curvature change region, the blade thickness initially decreases progressively, with a convex profile of the side surface contour. Adjoining this, the side surface contour merges into a concave profile, such that over this region of the blade height, the blade thickness decreases degressively in the radially outward direction.

In a refinement of the subject matter of the bottle-shaped blade thickness distribution, the side surface contour of the respective rotor blade has in each case one straight or one curved second transition region (bottleneck) between its radial blade edge and its curvature change region. In this case, the profile of the side surface contour, that is to say the side surface curvature, may terminate in the direction of the radial blade edge with a predefined curvature, or may be designed so as to be inclined with respect to an imaginary central plane of the rotor blade cross section under consideration or so as to be parallel with respect to said central line, such that a second transition region is realized which, in the cross section of the rotor blade, has for example a trapezoidal taper or a uniform thickness. The overall result, as viewed in cross section, is thus a side surface curvature of the rotor blade which is similar to the contour line of a bottle, hence the name used here.

An Eiffel Tower-shaped blade thickness distribution constitutes an inertia- and stress-optimized geometry and, at least on one side surface of the rotor blade, but preferably on both sides (pressure side and suction side), has a concave profile of the side surface contour, that is to say of the side surface curvature of the rotor blade, in the radially outward direction, such that the blade thickness decreases degressively over the blade height in the radially outward direction.

The termination of the side surface curvature in the direction of the radial blade edge may in this case be configured such that the concavely curved profile of the side surface contour of the respective rotor blade is extended in continuous fashion in the direction of the radial blade edge or merges into a straight profile which is inclined toward an imaginary central line of the rotor blade cross section or which is parallel to said central line, such that a transition region is realized which, in the cross section of the rotor blade, has a trapezoidal taper in the radially outward direction or a uniform thickness.

The termination in the blade root region may be formed from the curvature of the blade side wall or may be implemented with an additional root rounding. As a result, as viewed in cross section, a side surface curvature of the rotor blade is realized which is similar to the contour line of the Eiffel Tower, hence the name used here.

Further advantageous embodiments and refinements of the rotor according to the invention having the features specified above will be explained below in the description of the figures.

The advantages of a rotor according to the invention consist in particular in that the rotor is optimized with regard to the characteristics demanded of it during operation, in particular with regard to its rigidity, inertia and strength. The claimed blade thickness distribution may be used for cast, eroded and milled radial, radial-axial and axial turbines or compressors. Furthermore, the invention favors the manufacturing-related boundary conditions for casting with regard to minimal spacings between mutually adjacent blades.

In the case of production by casting, it is possible for the blade thickness distribution to be set as desired both by way of the blade height and also by way of the blade length. This possibility is utilized in the case of the present invention so as to realize an inertia-optimized thickness distribution in regions of the rotor blades that are of secondary significance with regard to blade strength, and to realize a rigidity-optimized thickness distribution in regions of the rotor blades that are at risk of vibration. The regions of low significance with regard to the overall blade rigidity are the regions at a low blade height in the radial direction. The regions with a large influence on blade rigidity are the regions at a high blade height in the radial direction.

The thickness distribution strategy according to the invention is based on a combination of the two fundamentally different blade thickness distributions, specifically for example an Eiffel Tower-shaped blade thickness distribution and a bottle-shaped blade thickness distribution, such that the rotor blades have, along their extent from the fluid inlet edge to the fluid outlet edge, at least one transition between a rigidity-oriented blade thickness distribution and an inertia- and stress-oriented blade thickness distribution over the blade height. In this case, the Eiffel Tower shape is optimized with regard to inertia and stress, whereas the bottle shape is optimized with regard to rigidity.

BRIEF DESCRIPTION OF THE SEVERAL VIEWS OF THE DRAWING

Exemplary embodiments of the invention will be explained in more detail below on the basis of the figures, in which.

DESCRIPTION OF THE INVENTION

Items of identical function and designation are denoted by the same reference signs throughout the figures.

Figure 1:
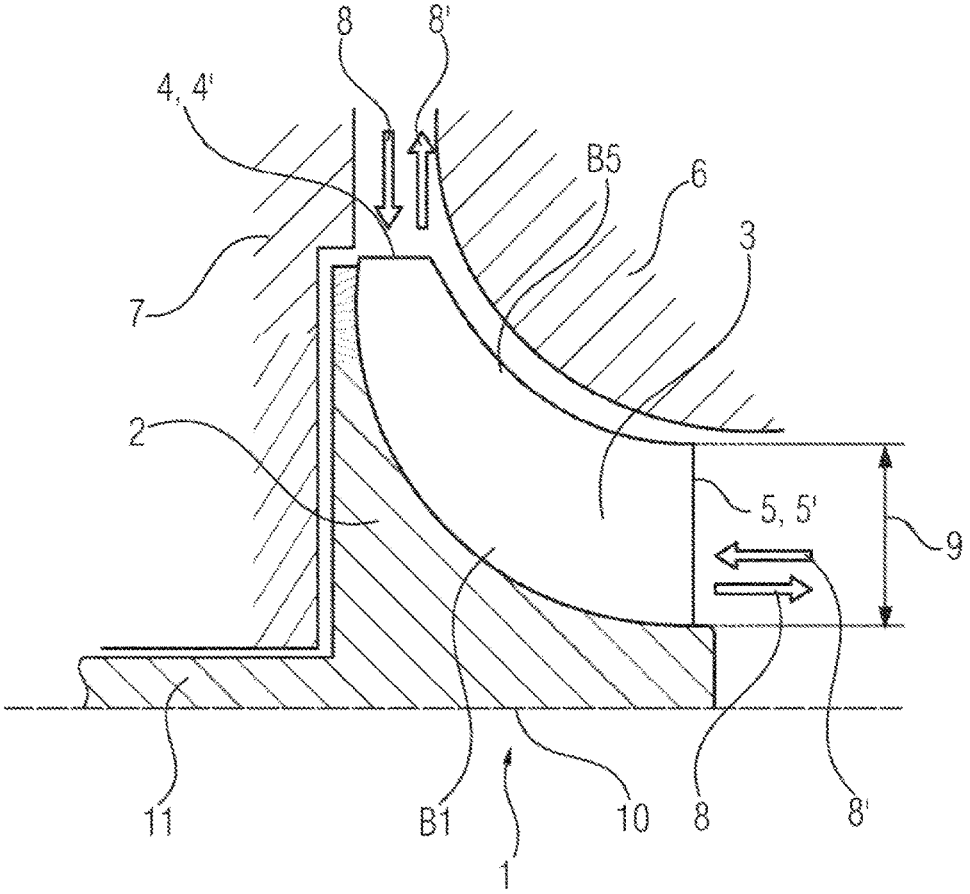
FIG. 1 shows a sketched partial section through a rotor of an exhaust-gas turbocharger (in the direction of the rotor axis of rotation) in order to illustrate the rotor blades in a side view.

FIG. 1 is a sketch illustrating a rotor of an exhaust-gas turbocharger, which in the exemplary embodiment shown is, for example, a turbine rotor of an exhaust-gas turbocharger. If it is a turbine rotor, this is arranged between the turbine housing 6 and the bearing housing 7 of the exhaust-gas turbocharger and rotates about a rotor axis of rotation 10 during the operation of the exhaust-gas turbocharger. The rotor 1 is connected rotationally conjointly by way of its rotor hub 2 to a rotor shaft 11. Rotor blades 3 are arranged on the rotor hub 2 equidistantly in the circumferential direction of the rotor, said rotor blades being fastened by way of their blade root B1 to the rotor hub 2. For example, the rotor hub 2 and the rotor blades 3 are manufactured in one step and are cohesively connected to one another.

The rotor blades 3 each have a fluid inlet edge 4, 5' and a fluid outlet edge 5, 4'. Since a turbine rotor and a compressor rotor scarcely differ in the schematic illustration, both embodiments are combined in one illustration in FIG. 1. Here, the main difference in the schematic illustration consists in the flow direction of the fluid flow.

The turbine rotor, which is impinged on by exhaust gases of an internal combustion engine, has an exhaust-gas inlet edge 4 and an exhaust-gas outlet edge 5. The flow direction of the exhaust gas is indicated in FIG. 1 by arrows and is denoted by the reference sign 8.

The compressor rotor, which is impinged on by fresh air, has a fresh air inlet edge 5' and a fresh air outlet edge 4'. The flow direction of the fresh air is indicated in FIG. 1 by arrows, which are denoted by the reference sign 8'.

In the case of the present invention, the rotor blades have, over their extent from the fluid inlet edge 4, 5' to the fluid outlet edge 5, 4', that is to say in each case in the flow direction of the fluid flow, a specific blade thickness distribution by means of which the rotor blades are optimized during operation with regard to their rigidity, their inertia and their strength.

Figure 2:
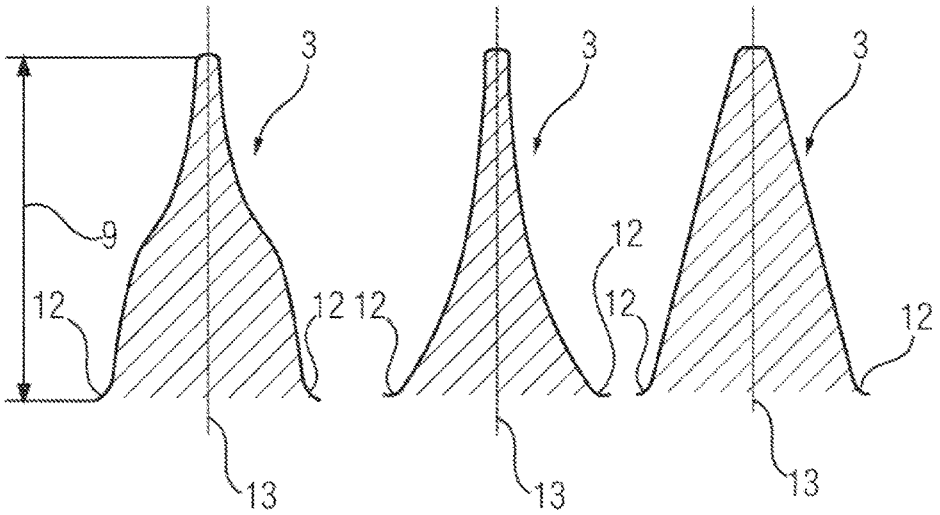
FIG. 2 shows three examples of different blade thickness distributions over the blade height in a sectional illustration of a rotor blade (in a section plane running perpendicular to the rotor axis of rotation)

FIG. 2 shows three examples of blade thickness distributions over the blade height 9 of a rotor blade 3 in a sectional illustration with a section plane running perpendicular to the rotor axis of rotation 10. In this case, the left-hand illustration in FIG. 2 illustrates a bottle-shaped blade thickness distribution, the middle illustration of FIG. 2 illustrates an Eiffel Tower-shaped blade thickness distribution, and the right-hand illustration of FIG. 2 illustrates a trapezoidal blade thickness distribution. In this case, the respective blade thickness distribution is, by way of example, of symmetrical form with respect to an imaginary blade central line 13 of the respective rotor blade cross section. Said blade thickness distributions have in common the fact that, in their respective root region, that is to say in the region of connection to the rotor hub (not illustrated), the thickness of the respective rotor blade is at its greatest, and in its radial blade edge region, which is arranged opposite the root region, the thickness of the respective rotor blade is at its smallest. Illustrated in the root region in each case is a root rounding 12, which constitutes the transition to the rotor hub.

In the case of the rotor blades being produced by casting, it is possible for the blade thickness distribution to be set as desired. This possibility is utilized in the case of the invention so as to realize an inertia-optimized thickness distribution in regions of the rotor blades that are of secondary significance with regard to blade strength, and to realize a rigidity-optimized thickness distribution in regions of the rotor blades that are at risk of vibration.

The regions of low significance with regard to the overall blade rigidity are the blade regions at a low blade height. The regions with a large influence or impact on blade rigidity are the regions at a high blade height.

In the case of the invention, a blade thickness distribution is realized such that two fundamentally different blade thickness distributions, for example the Eiffel Tower shape and the bottle shape, alternate with one another or are combined with one another in a particular way. The Eiffel Tower shape is optimal with regard to inertia and stress. The bottle shape is optimal with regard to rigidity.

The Eiffel Tower shape is characterized in particular by a profile of the side surface contour which, in the radially outward direction proceeding from the root region, is curved initially inward toward the imaginary central line 13, wherein the blade thickness decreases degressively in the radially outward direction. In the direction of the radial blade edge, the side surface contour may terminate as a continuation of the Eiffel Tower shape, as can be seen from the middle illustration of FIG. 2, or may also merge into a straight profile inclined toward an imaginary central line of the rotor blade or parallel to said central line, such that a transition region is realized, the cross-sectional area of which has a trapezoidal taper in the radially outward direction or a uniform thickness. In this case, the root region may be formed by the curvature of the blade side wall. Alternatively, the root region may also be implemented with an additional root rounding 12.

By contrast thereto, the bottle shape illustrated in the left-hand illustration of FIG. 2 is characterized in particular by a curvature change region in which, in the direction from radial inside to radial outside, the side surface contour of the rotor blade merges from a convex curvature into a concave curvature.

The trapezoidal blade thickness distribution shown in the right-hand illustration of FIG. 2 is used in the case of known blade thickness distributions according to the prior art, and in this case is provided in continuous form between the fluid inlet edge and the fluid outlet edge in the flow direction.

Figure 3:
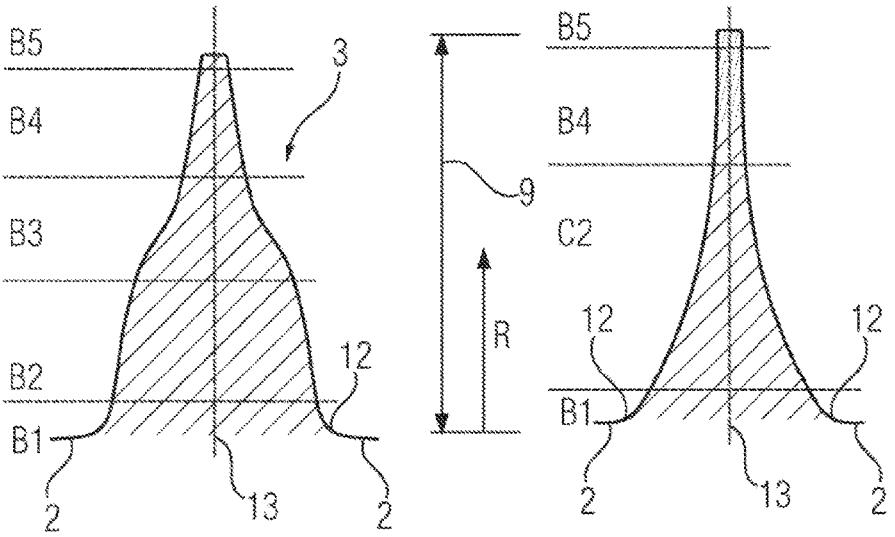
FIG. 3 illustrates the blade thickness distributions in the case of bottle-shaped and Eiffel Tower-shaped blade thickness distributions over the blade height of a rotor blade, in sectional illustrations as per FIG. 2.

FIG. 3 shows an example in each case of a rigidity-optimized blade thickness distribution, referred to as a bottle shape, and of an inertia- and stress-optimized blade thickness distribution, referred to as Eiffel Tower shape, in a sectional illustration in a section plane perpendicular to the rotor axis of rotation 10. For easier explanation, the respective blade thickness distribution is, in FIG. 3, divided into regions B1 to B5 in the case of the bottle shape and divided into the regions B1, C2, B4 and B5 in the case of the Eiffel Tower shape, wherein in both cases, B1 is the blade root region and B5 is the radially outer blade edge region.

Furthermore, in the case of the bottle shape, a first transition region B2 (bottle bulge), a curvature change region B3 (bottle shoulder) and a second transition region B4 (bottle neck) are predefined. In the case of the Eiffel Tower shape, a concave region C2 and, likewise, a transition region B4 are predefined between the blade root B1 and the blade edge region B5.

The root region or blade root B1, in which the rotor blade 3 is connected to the hub, has in each case the greatest thickness and preferably merges via a root rounding 12 into the rotor hub 2. The radially outer blade edge terminates the side surface contour with a defined edge, and is in each case preferably of slightly rounded form, wherein the rounding follows the respective circumferential circle of the rotor, or is defined thereby.

In the case of the bottle shape, the side surface contour of the rotor blade may be of straight or preferably slightly convexly curved form in the first transition region B2 provided between the root region B1 and the curvature change region B3. As has already been stated above, in the curvature change region B3, the side surface contour changes from a convex curvature to a concave curvature.

The Eiffel Tower shape is characterized in particular by the concave region C2 which adjoins the root region and in which the side surface contour has a profile which, in the radial direction R toward the outside, has a profile which is concavely arched toward the imaginary central line 13, wherein the blade thickness decreases degressively in the radially outward direction.

In the transition region B4 provided between the curvature change region B3 or the concave region C2 and the radially outer blade end region B5, it is in both cases possible, in turn, for the side surface contour to run onward with a slight concave curvature or to merge into a profile which is inclined toward an imaginary central line of the rotor blade cross section or which is parallel to said central line, such that a transition region is realized, the cross-sectional area of which has a trapezoidal taper in the radially outward direction or a uniform thickness.

Those sections of the individual regions B1 to B5 and C2 which extend in the radial direction R may be optimized in terms of their extent and their relationship with respect to one another in a manner dependent on the specific application in each case, wherein also, the sections of the individual regions B1 to B5 are split up in a manner dependent on the position along the extent of the rotor blade between fluid inlet edge and fluid outlet edge and on the blade height at that position. Also, the gradient of the profile of the side surface contour in the curvature change region B3 may be optimized in a manner dependent on the respective application in order to attain the best possible compromise between rigidity and inertia.

Figure 4:
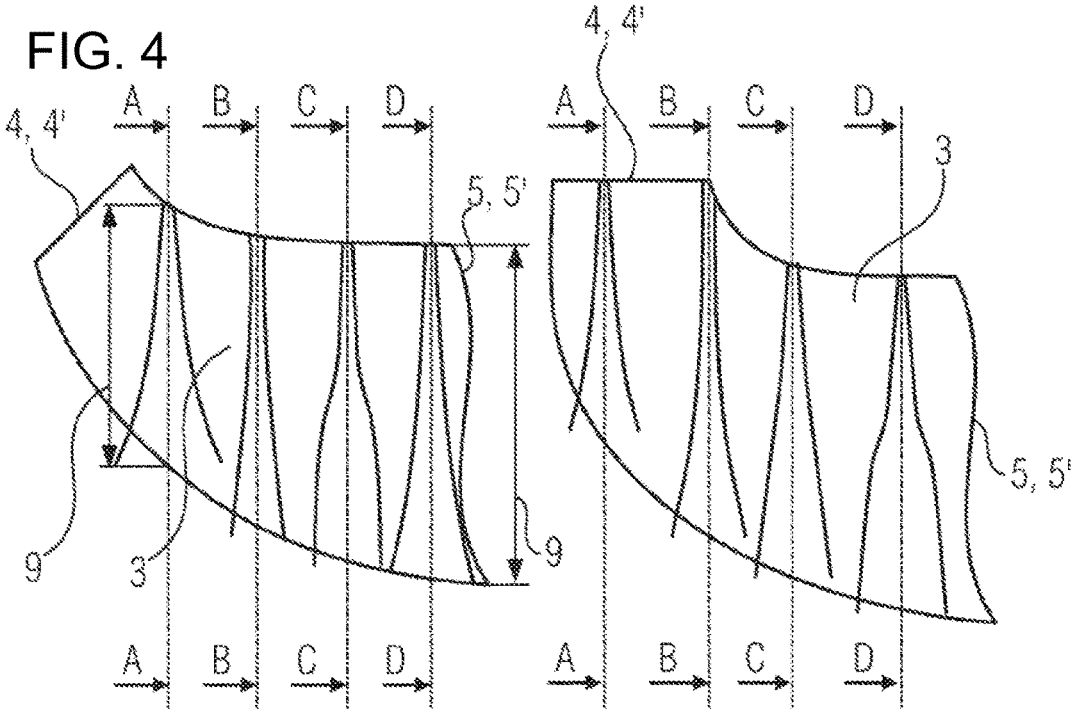
FIG. 4 shows two examples illustrating blade thickness distributions over the blade height and the extent of a rotor blade in an axial direction, in a meridional view of the rotor blades.

Two examples for illustrating blade thickness distributions according to the invention are schematically shown in FIG. 4 in a meridional view of the rotor blades. In this case, the left-hand illustration relates to a radial-axial rotor, and the right-hand illustration relates to a radial rotor. The embodiments described below may be used both for turbine rotors and for compressor rotors. In the case of a turbine rotor, the fluid inlet edge 4 is the region of small blade height (the left-hand region of the illustration in each case), and the fluid outlet edge 5 is the region of large blade height (the right-hand region of the illustration in each case). In the case of a compressor rotor, the fluid inlet edge 5' is the region of large blade height (the right-hand region of the illustration in each case), and the fluid outlet edge 4' is the region of small blade height (the left-hand region of the illustration in each case).

For clarity, the root regions are not shown in either illustration. Since the meridional view illustrated constitutes a projection of the three-dimensional rotor blade onto a two-dimensional plane, the deflection angle of the blades is not reflected in the illustrations. Owing to the deflection angles that are actually present, and the fact that the thickness distributions are considered in a section plane perpendicular to the rotor axis of rotation, it is generally the case that, by contrast to the illustration, the actual contour profiles of the side surface contours on the two sides of the rotor blades in this section plane are not absolutely symmetrical in the section planes A to D shown in FIG. 4, even though, in principle, said side surface contours have the same contour profile. In reality, depending on the deflection angle of the blade, there are slightly different contour profiles on the two sides. The sectional illustrations A to D as per FIG. 4 are thus to be understood as blade thickness distributions perpendicular to the skeleton surface (which is defined approximately by an imaginary central line of the profile over the course of the blade length and which appears as a central line in the respective section) of the blade profile.

The thickness distribution illustrated in the right-hand illustration (radial rotor) has an Eiffel Tower-shaped blade thickness distribution in the region of small radial blade height and simultaneously at a relatively large distance from the rotor axis of rotation, section A-A, and merges continuously in the axial direction (to the right in the illustration), as can be seen from sections B-B and C-C, into a bottle-shaped blade thickness distribution in the region of large radial blade height and simultaneously at a relatively small distance from the rotor axis of rotation 10, section D-D. Such a distribution conforms to the rule that a rigidity-oriented blade thickness distribution in particular is advantageous at large blade heights, whereas an inertia- and stress-oriented blade thickness distribution is preferable at small blade height. At the same time, however, said distribution has the additional effect that the relatively large mass arrangements required for rigidity, in the form of the "bottle bulge" of the bottle-shaped blade thickness distribution, are arranged closer to the rotor axis of rotation and thus have less of an adverse effect on the mass inertia of the rotor and thus on the transient behavior of the turbocharger.

In the left-hand illustration, the axial-radial rotor, the Eiffel Tower-shaped blade thickness distribution in section A-A initially merges, in the direction of large blade height (to the right in the illustration), into the bottle-shaped blade thickness distribution, section C-C. Toward the fluid outlet/fluid inlet edge 5, 5', there is then a transition to the Eiffel Tower-shaped blade thickness distribution again. Said additional transition and the Eiffel Tower-shaped blade thickness distribution present at the fluid outlet/fluid inlet edge 5, 5' may optionally be used firstly to reduce critical stresses in the hub region of the fluid outlet/fluid inlet edge 5, 5' and secondly to achieve aerodynamic advantages through reduction of the thickness of the fluid outlet/fluid inlet edge 5, 5' and/or of the corresponding edge radius.

The transition regions present, in the axial direction, between different blade thickness distributions have cross-sectional shapes which correspond to a combination of an Eiffel Tower-shaped blade thickness distribution and a bottle-shaped blade thickness distribution.

Figure 5:
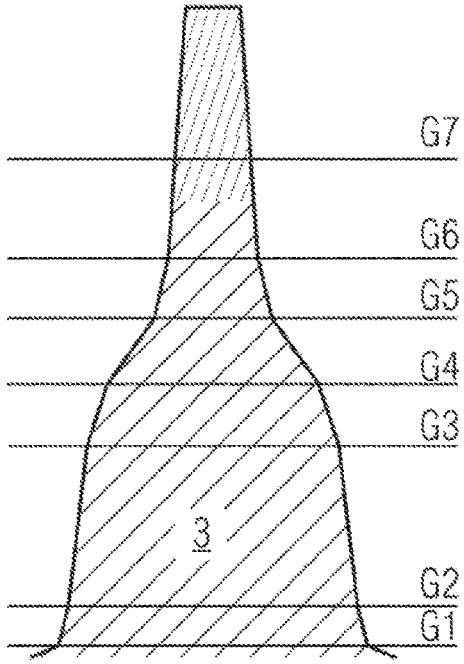
FIG. 5 shows an example illustrating an exemplary embodiment with in each case straight-running sections of a side surface contour.

FIG. 5 shows an example illustrating a special embodiment of the invention. In this embodiment, the respective profile of the side surface contour of the rotor blade 3, illustrated in this case on the basis of the example of the bottle-shaped blade thickness distribution, but transferable in the same way to an Eiffel Tower-shaped blade thickness distribution, has in each case a multiplicity of in each case straight-running contour sections G1 to G7 toward the outside in the radial direction. The individual straight-running contour sections lined up together however result, in turn, in a bottle-shaped or Eiffel Tower-shaped blade thickness distribution as a superordinate geometry.

This embodiment has the advantage of making it possible for the rotor blades to be manufactured in a multi-row milling process.

Figure 6:
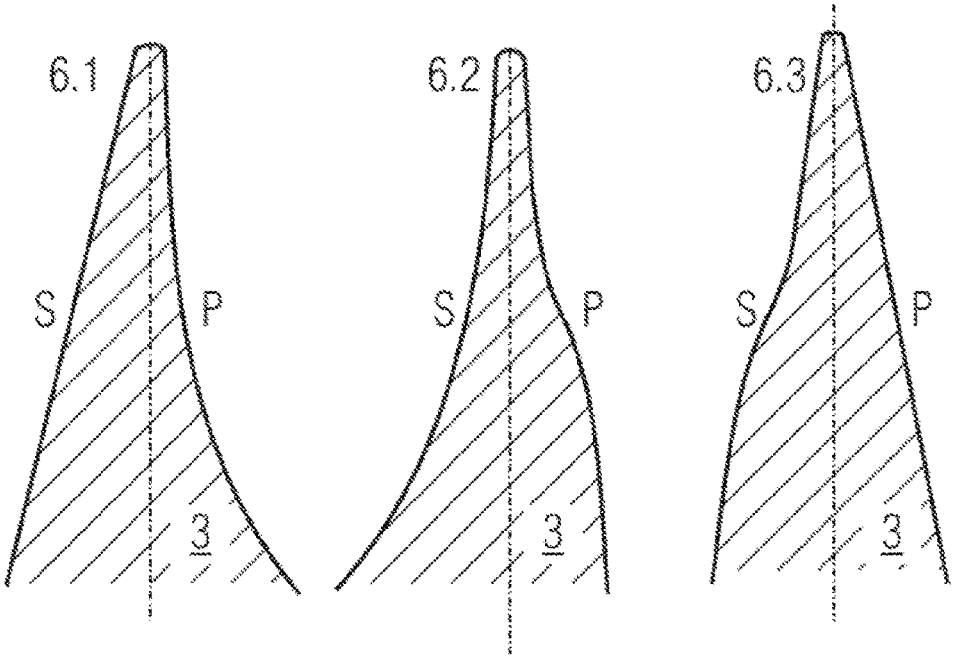
FIG. 6 shows examples illustrating different embodiments of asymmetrical blade thickness distributions, in a sectional illustration as per FIG. 2.

FIG. 6 shows examples illustrating further embodiments of the invention.

In the case of the thickness distributions described on the basis of the preceding figures, there is in each case a substantially symmetrical profile of the side surface contour of the rotor blades on both sides of the rotor blades, the suction side and the pressure side, as shown in sectional illustration.

By contrast, FIG. 6 shows examples of a different, asymmetrical blade thickness distribution on the suction side S and on the pressure side P of the rotor blades 3, wherein the two outer contours have different contour profiles with respect to an imaginary central line. The designations "suction side" and "pressure side" of the rotor blades are freely selected in this case, and serve merely for making a distinction between the two blade sides.

Illustration 6.1 of FIG. 6 shows, for example, a blade thickness distribution which diminishes in straight trapezoidal form in the radially outward direction on the suction side S, and an Eiffel Tower-shaped blade thickness distribution on the pressure side P of the rotor blade 3. By contrast, illustration 6.2 shows an Eiffel Tower-shaped blade thickness distribution on the suction side S and a bottle-shaped blade thickness distribution on the pressure side P. Illustration 6.3 in turn shows a bottle-shaped blade thickness distribution on the suction side S and a conical blade thickness distribution on the pressure side P. In this case, it is by all means possible to realize further combinations of different blade thickness distributions not shown here. By means of such asymmetrical blade thickness distributions on the suction side and pressure side S, P, it is possible for thermally induced stresses in the blade material, internal stresses in the blade material and aerodynamic forces that arise during operation to be counteracted. Alternatively or in addition, this may also be realized by virtue of the blades no longer being aligned exactly with radial rays but being slightly inclined or curved in a circumferential direction.

Figure 7:
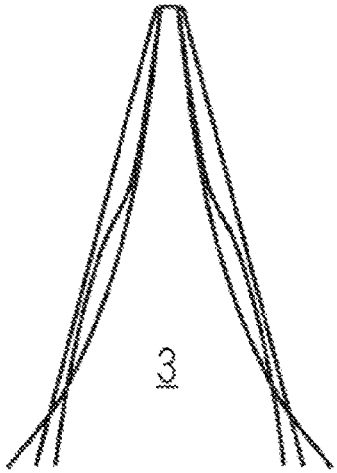
FIG. 7 is a superposed illustration illustrating different blade thickness distributions in a sectional illustration as per FIG. 2.

FIG. 7 shows a superposed illustration of sectional views in order to show different blade thickness distributions. These blade thickness distributions are the embodiments that have already been shown above in FIG. 2.

From the superposition, however, it can be seen that the maximum thickness in the blade root region in the case of a bottle-shaped blade thickness distribution is smaller, while achieving the same rigidity and strength, than in the case of a conical blade thickness distribution.

Both in the case of the bottle-shaped blade thickness distribution and in the case of the Eiffel Tower-shaped blade thickness distribution, the smallest blade thickness that can be realized from a production aspect extends over larger parts of the blade height of the rotor blade than in the case of a conical blade thickness distribution. Owing to this configuration, a reduction in inertia is achieved with the blade thickness distribution according to the invention. At the same time, however, rigidity can be maintained in relation to the conical blade thickness distribution, because approximately the maximum thickness in the blade root region is used over larger parts of the blade height.

Furthermore, from a manufacturing aspect, it is necessary to maintain a minimum blade spacing in the region of the blade root, and a minimum rounding. This criterion is relatively easy to satisfy in the case of a rotor according to the invention, because the maximum blade thickness is smaller than in the case of a conical blade thickness distribution. It is thus possible for the number of blades to be increased, which has an advantageous effect on thermodynamic efficiency.

The presence of a constant blade thickness in the region of large diameter, that is to say in the transition region B4 in the vicinity of the radial blade edge B5, improves the capability for castable blanks to be created, using CAD, on the basis of the finished part. For the establishment of measurements, use may be made of a surface extrapolation, because the thickness in the radial blade end region remains constant in the case of a rotor according to the invention. Furthermore, in the case of contour turning, a trim adaptation of a base design may be performed without the thickness of the radial blade end region being changed.

The maximum of the thickness at the hub may be located at virtually any desired position in the flow direction. If situated in an ideal position perpendicular to the oscillation axis of the lowest eigenform, then the maximum blade thickness can be minimized because rigidity is optimized. This benefits the inertia of the turbocharger.

If the aerodynamic quality of the blade thickness distribution is incorporated into the optimization, then it is for example also possible for the wedge angle of the fluid outlet edge to be optimized toward more acute outlet angles by positioning of the maximum of the thickness at the hub. Here, in the case of a turbine rotor, the radial thickness distribution of the fluid outlet edge 5 is in turn configured in an Eiffel Tower shape, as shown in the left-hand illustration of FIG. 4 in the section D-D. In comparison with a continuously conical blade thickness distribution, the blade thickness distribution according to the invention permits a shallower wedge angle at the fluid outlet edge 5 of turbine rotor blades. The subject matter of the invention can advantageously also be utilized to reduce the so-called cut-back by means of improved rigidity of the turbine blade arrangement.

The invention claimed is:

1. A rotor of an exhaust-gas turbocharger, the rotor comprising:

a rotor hub;

rotor blades disposed on said rotor hub, said rotor blades each having a fluid inlet edge, a fluid outlet edge, a blade root, a radial blade edge, a blade height extending in a direction radially away from said rotor hub to said radial blade edge, a blade length extending from said fluid inlet edge to said fluid outlet edge, a first side surface contour, a second side surface contour located opposite said first side surface contour, and a blade thickness distribution defined between said first side surface contour and an imaginary central line of a cross section extending between said first and second side surface contours;

said blade thickness distribution being selected to provide said rotor blades, along an extent thereof from said fluid inlet edge to said fluid outlet edge, with at least one transition between a first thickness distribution extending over said blade height and a second thickness distribution extending over said blade height;

wherein said blade thickness distribution at said fluid inlet edge is said second thickness distribution extending over said blade height and said blade thickness distribution at said fluid inlet edge merges into said first thickness distribution at a location disposed away from said fluid inlet edge;

wherein said first thickness distribution requires said first side surface contour to have a curvature change region in which said first side surface contour changes from a convex profile to a concave profile as said first side surface contour extends in a radially outwardly extending direction; and wherein said second thickness distribution requires said first side surface contour to have a concave profile causing a blade thickness to decrease degressively over the blade height as said first side surface contour extends in the radially outwardly extending direction.

2. The rotor according to claim 1, wherein said curvature change region is between said blade root and said radial blade edge.

3. The rotor according to claim 2, wherein said first side surface contour has one straight or one curved first transition region between said blade root and said curvature change region.

4. The rotor according to claim 3, wherein said first side surface contour has one straight or one curved second transition region between said radial blade edge and said curvature change region.

5. The rotor according to claim 1, wherein said concave profile of said first thickness distribution is between said blade root and said radial blade edge and said concave profile of said second thickness distribution is between said blade root and said radial blade edge.

6. The rotor according to claim 5, wherein said concave profile of said second thickness distribution merges, in a direction toward said radial blade edge, into a profile being inclined toward said imaginary central line or being parallel to said central line, forming a transition region having a trapezoidal taper in a radially outward direction or a uniform thickness, in said cross section of the rotor blade.

7. The rotor according to claim 1, wherein said first side surface contour also has a multiplicity of straight-running contour sections in a radially outward direction in an area of said first thickness distribution and in an area of said second thickness distribution.

8. The rotor according to claim 1, wherein said rotor blades each have a suction side and a pressure side with identical blade thickness distributions on said suction side and on said pressure side, and said first and second side surface contours of said respective rotor blades run symmetrically relative to one another about said imaginary central line.

9. The rotor according to claim 1, wherein said rotor blades each have a suction side and a pressure side with different blade thickness distributions on said suction side and on said pressure side, and said first and second side surface contours have different contour profiles relative to said imaginary central line.

* * * * *